US009516894B2

(12) United States Patent
Gee et al.

(10) Patent No.: US 9,516,894 B2
(45) **Date of Patent: *Dec. 13, 2016**

(54) MOIST BOTANICAL POUCH PROCESSING AND MOIST ORAL BOTANICAL POUCH PRODUCTS

(71) Applicant: Philip Morris USA Inc., Richmond, VA (US)

(72) Inventors: Diane L. Gee, Richmond, VA (US); David Golob, Richmond, VA (US); Stephen G. Zimmermann, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 587 days.

This patent is subject to a terminal disclaimer.

(21) Appl. No.: 13/768,054

(22) Filed: Feb. 15, 2013

(65) Prior Publication Data

US 2013/0152955 A1 Jun. 20, 2013

Related U.S. Application Data

(62) Division of application No. 12/642,399, filed on Dec. 18, 2009, now Pat. No. 8,377,215.

(Continued)

(51) Int. Cl.

| | |
|---|---|
| ***A24B 15/30*** | (2006.01) |
| ***A24B 13/00*** | (2006.01) |
| ***A24B 15/16*** | (2006.01) |

(52) U.S. Cl.

CPC ..... *A24B 15/30* (2013.01); *A24B 13/00* (2013.01); *A24B 15/16* (2013.01)

(58) Field of Classification Search

None

See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |

(Continued)

FOREIGN PATENT DOCUMENTS

| | | | |
|---|---|---|---|
| EP | 0212234 | A2 | 7/1986 |
| EP | 0145499 | B1 | 4/1989 |

(Continued)

OTHER PUBLICATIONS

El Saleh, F. et al., "Influence of Cellulose Type on the Properties of Extruded Pellets", S.T.P. Pharma Sciences 10, (5), 2000, pp. 379-385.

(Continued)

*Primary Examiner* — Michael H Wilson

*Assistant Examiner* — Phu Nguyen

(74) *Attorney, Agent, or Firm* — Buchanan Ingersoll & Rooney PC

(57) ABSTRACT

An oral pouched product comprising a pouch containing moist botanical beads comprising compacted loose, fibrous moist botanical material and method of manufacture thereof. The loose, fibrous moist botanical material can comprise moist smokeless tobacco. The pouch comprises a porous outer web, and the beads comprise a majority amount of loose, fibrous moist botanical material having a moisture content of at least about 50% OV.

7 Claims, 4 Drawing Sheets

Related U.S. Application Data

(60) Provisional application No. 61/138,833, filed on Dec. 18, 2008.

(56) References Cited

U.S. PATENT DOCUMENTS

| | | | |
|---|---|---|---|
| 1,376,586 | A | 5/1921 | Schwartz |
| 1,992,152 | A | 2/1935 | Yeates |
| 2,313,696 | A | 3/1941 | Yates |
| 2,306,400 | A | 12/1942 | Menzel |
| 2,318,101 | A | 5/1943 | Rose |
| 2,330,361 | A | 9/1943 | Howard |
| 2,528,778 | A | 11/1950 | Piazze |
| 3,067,068 | A | 12/1962 | Finberg |
| 3,162,199 | A | 12/1964 | Moll, Jr. |
| 3,174,889 | A | 3/1965 | Anderson et al. |
| 3,188,265 | A | 6/1965 | Charbonneau et al. |
| 3,203,432 | A | 8/1965 | Green et al. |
| 3,353,543 | A | 11/1967 | Sproull et al. |
| 3,369,551 | A | 2/1968 | Carroll |
| 3,415,286 | A | 12/1968 | Arnold et al. |
| 3,600,807 | A | 8/1971 | Sipos |
| 3,607,299 | A | 9/1971 | Bolt |
| 3,692,536 | A | 9/1972 | Fant |
| 3,757,798 | A | 9/1973 | Lambert |
| 3,846,569 | A | 11/1974 | Kaplan |
| 3,881,024 | A | 4/1975 | Pahoundis, Sr. et al. |
| 3,932,192 | A | 1/1976 | Nakashio et al. |
| 4,109,663 | A | 8/1978 | Maeda et al. |
| 4,218,286 | A | 8/1980 | Jones et al. |
| 4,240,016 | A | 12/1980 | Inaba et al. |
| 4,341,228 | A | 7/1982 | Keritsis et al. |
| 4,347,855 | A | 9/1982 | Lanzillotti et al. |
| 4,347,857 | A | 9/1982 | Boden |
| 4,355,995 | A | 10/1982 | Berger |
| 4,357,950 | A | 11/1982 | Berger |
| 4,386,106 | A | 5/1983 | Merritt et al. |
| 4,510,950 | A | 4/1985 | Keritsis |
| 4,545,392 | A | 10/1985 | Sensabaugh et al. |
| 4,565,702 | A | 1/1986 | Morley et al. |
| 4,607,479 | A | 8/1986 | Linden |
| 4,624,269 | A | 11/1986 | Story et al. |
| 4,660,577 | A | 4/1987 | Sensabaugh et al. |
| 4,674,519 | A | 6/1987 | Keritsis et al. |
| 4,702,264 | A | 10/1987 | Graves, Jr. |
| 4,703,765 | A | 11/1987 | Paules et al. |
| 4,797,287 | A | 1/1989 | Pich et al. |
| 4,821,749 | A | 4/1989 | Toft et al. |
| 4,874,000 | A | 10/1989 | Tamol et al. |
| 4,880,018 | A | 11/1989 | Graves, Jr. et al. |
| 4,880,697 | A | 11/1989 | Caldwell et al. |
| 4,892,483 | A | 1/1990 | Douglas, Jr. |
| 4,893,639 | A | 1/1990 | White |
| 4,906,488 | A | 3/1990 | Pera |
| 4,907,605 | A | 3/1990 | Ray et al. |
| 4,917,161 | A | 4/1990 | Townend |
| 4,924,887 | A | 5/1990 | Raker et al. |
| 4,966,171 | A | 10/1990 | Serrano et al. |
| 4,981,522 | A | 1/1991 | Nichols et al. |
| 4,989,620 | A | 2/1991 | Keritsis et al. |
| 5,007,440 | A | 4/1991 | Robinson et al. |
| 5,099,864 | A | 3/1992 | Young et al. |
| 5,105,836 | A | 4/1992 | Gentry et al. |
| 5,127,208 | A | 7/1992 | Custer et al. |
| 5,148,821 | A | 9/1992 | Best et al. |
| 5,167,244 | A | 12/1992 | Kjerstad |
| 5,174,088 | A | 12/1992 | Focke et al. |
| 5,186,185 | A | 2/1993 | Mashiko et al. |
| 5,211,985 | A | 5/1993 | Shirley, Jr. et al. |
| 5,240,016 | A | 8/1993 | Nichols et al. |
| 5,263,999 | A | 11/1993 | Baldwin et al. |
| 5,339,838 | A | 8/1994 | Young et al. |
| 5,346,734 | A | 9/1994 | Wydick, Jr. |
| 5,372,149 | A | 12/1994 | Roth et al. |
| 5,387,416 | A | 2/1995 | White et al. |
| 5,501,237 | A | 3/1996 | Young et al. |
| 5,525,351 | A | 6/1996 | Dam |
| 5,549,906 | A | 8/1996 | Santus |
| 5,598,868 | A | 2/1997 | Jakob et al. |
| 5,601,716 | A | 2/1997 | Heinrich et al. |
| 5,724,998 | A | 3/1998 | Gellatly et al. |
| 5,725,886 | A | 3/1998 | Erkoboni et al. |
| 5,726,161 | A | 3/1998 | Whistler |
| 5,763,083 | A | 6/1998 | Berrigan |
| 5,773,062 | A | 6/1998 | Cirigliano et al. |
| 5,806,408 | A | 9/1998 | DeBacker et al. |
| 5,829,453 | A | 11/1998 | White et al. |
| 5,845,648 | A | 12/1998 | Martin |
| 5,921,955 | A | 7/1999 | Mazer et al. |
| 5,927,052 | A | 7/1999 | Nippes et al. |
| 5,997,691 | A | 12/1999 | Gautam et al. |
| 6,021,624 | A | 2/2000 | Richison et al. |
| 6,026,820 | A | 2/2000 | Baggett, Jr. et al. |
| 6,135,120 | A | 10/2000 | Löfman et al. |
| 6,143,316 | A | 11/2000 | Hayden et al. |
| 6,146,655 | A | 11/2000 | Ruben |
| 6,162,516 | A | 12/2000 | Derr |
| 6,280,761 | B1 | 8/2001 | Santus |
| 6,287,612 | B1 | 9/2001 | Mandava et al. |
| 6,325,859 | B1 | 12/2001 | De Roos et al. |
| 6,383,475 | B1 | 5/2002 | Meyers et al. |
| 6,414,033 | B1 | 7/2002 | Sceusa |
| 6,444,253 | B1 | 9/2002 | Conklin et al. |
| 6,455,068 | B1 | 9/2002 | Licari |
| D489,606 | S | 5/2004 | Lofman |
| 6,761,174 | B2 | 7/2004 | Jupe et al. |
| 6,840,248 | B2 | 1/2005 | Zielke |
| 6,871,473 | B1 | 3/2005 | Dutt et al. |
| 6,873,072 | B2 | 3/2005 | Ganter et al. |
| 6,878,695 | B2 | 4/2005 | Woo et al. |
| 6,880,018 | B1 | 4/2005 | Kajiki et al. |
| 6,895,974 | B2 | 5/2005 | Peele |
| 6,942,848 | B2 | 9/2005 | Nelson et al. |
| 6,958,429 | B2 | 10/2005 | Bruhn et al. |
| 6,982,093 | B2 | 1/2006 | Licari |
| 6,984,376 | B2 | 1/2006 | Stephenson et al. |
| 7,030,092 | B1 | 4/2006 | Levine |
| 7,032,601 | B2 | 4/2006 | Atchley et al. |
| 7,065,689 | B2 | 6/2006 | Chiu et al. |
| 7,090,858 | B2 | 8/2006 | Jayaraman |
| 7,115,586 | B2 | 10/2006 | Loftsson |
| 7,186,701 | B2 | 3/2007 | Kubota et al. |
| 7,348,035 | B2 | 3/2008 | Schleifenbaum et al. |
| D568,576 | S | 5/2008 | Neidle et al. |
| D585,626 | S | 2/2009 | Chappell, Sr. et al. |
| 7,578,298 | B2 | 8/2009 | Karles et al. |
| 7,584,843 | B2 | 9/2009 | Kutsch et al. |
| 7,585,538 | B2 | 9/2009 | Mangos et al. |
| 7,694,686 | B2 | 4/2010 | Atchley et al. |
| 7,810,507 | B2 | 10/2010 | Dube et al. |
| 7,819,124 | B2 | 10/2010 | Strickland et al. |
| 7,856,988 | B2 | 12/2010 | Yang et al. |
| 7,861,728 | B2 | 1/2011 | Holton, Jr. et al. |
| 7,866,324 | B2 | 1/2011 | Jupe et al. |
| 7,913,699 | B2 | 3/2011 | Strickland et al. |
| 7,913,700 | B2 | 3/2011 | Calandro et al. |
| 7,918,231 | B2 | 4/2011 | Strickland et al. |
| 7,950,399 | B2 | 5/2011 | Winterson et al. |
| 7,980,251 | B2 | 7/2011 | Winterson et al. |
| 8,029,837 | B2 | 10/2011 | Gedevanishvili et al. |
| 8,053,008 | B2 | 11/2011 | Sweeney et al. |
| 8,067,046 | B2 | 11/2011 | Schleef et al. |
| 8,119,173 | B2 | 2/2012 | Cheng et al. |
| 8,124,147 | B2 | 2/2012 | Cheng et al. |
| 8,202,589 | B2 | 6/2012 | Gedevanishvili et al. |
| 8,268,370 | B2 | 9/2012 | Miser et al. |
| 8,323,683 | B2 | 12/2012 | Mody et al. |
| 8,685,478 | B2 | 4/2014 | Neidle et al. |
| 2002/0012689 | A1 | 1/2002 | Stillman |
| 2002/0170567 | A1 | 11/2002 | Rizzotto et al. |
| 2003/0224090 | A1 | 12/2003 | Pearce et al. |
| 2004/0018293 | A1 | 1/2004 | Popplewell et al. |
| 2004/0037879 | A1 | 2/2004 | Adusumilli et al. |
| 2004/0081691 | A1 | 4/2004 | Debregeas et al. |
| 2004/0118421 | A1 | 6/2004 | Hodin et al. |

(56) References Cited

U.S. PATENT DOCUMENTS

| | | | | |
|---|---|---|---|---|
| 2004/0191322 | A1 | 9/2004 | Hansson | |
| 2004/0202698 | A1 | 10/2004 | Ramji et al. | |
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0000531 | A1 | 1/2005 | Shi | |
| 2005/0003048 | A1 | 1/2005 | Pearce et al. | |
| 2005/0034738 | A1 | 2/2005 | Whalen | |
| 2005/0061339 | A1 | 3/2005 | Hansson et al. | |
| 2005/0081264 | A1 | 4/2005 | Brugliera et al. | |
| 2005/0098187 | A1 | 5/2005 | Grierson et al. | |
| 2005/0100640 | A1 | 5/2005 | Pearce | |
| 2005/0172976 | A1 | 8/2005 | Newman et al. | |
| 2005/0210615 | A1 | 9/2005 | Shastry et al. | |
| 2005/0241656 | A1 | 11/2005 | Kennison | |
| 2005/0244521 | A1 | 11/2005 | Strickland et al. | |
| 2005/0287249 | A1 | 12/2005 | Shukla et al. | |
| 2006/0039973 | A1 | 2/2006 | Aldritt et al. | |
| 2006/0073190 | A1 | 4/2006 | Carroll et al. | |
| 2006/0118589 | A1 | 6/2006 | Arnarp et al. | |
| 2006/0144412 | A1 | 7/2006 | Mishra et al. | |
| 2006/0191548 | A1 | 8/2006 | Strickland et al. | |
| 2006/0204598 | A1 | 9/2006 | Thompson | |
| 2006/0228431 | A1 | 10/2006 | Eben et al. | |
| 2007/0000505 | A1 | 1/2007 | Zhuang et al. | |
| 2007/0048431 | A1 | 3/2007 | Budwig et al. | |
| 2007/0062549 | A1 | 3/2007 | Holton, Jr. et al. | |
| 2007/0077307 | A1 | 4/2007 | Rosenberg et al. | |
| 2007/0107747 | A1 | 5/2007 | Hill et al. | |
| 2007/0190157 | A1 | 8/2007 | Sanghvi et al. | |
| 2007/0207239 | A1 | 9/2007 | Neidle et al. | |
| 2007/0261707 | A1 | 11/2007 | Winterson et al. | |
| 2007/0267033 | A1 | 11/2007 | Mishra et al. | |
| 2007/0298061 | A1 | 12/2007 | Boghani et al. | |
| 2008/0014303 | A1 | 1/2008 | Jacops et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0138489 | A1 | 6/2008 | Nagao et al. | |
| 2008/0166395 | A1 | 7/2008 | Roush | |
| 2008/0173317 | A1 | 7/2008 | Robinson et al. | |
| 2008/0196730 | A1 | 8/2008 | Engstrom et al. | |
| 2008/0202536 | A1 | 8/2008 | Torrence et al. | |
| 2008/0302682 | A1 | 12/2008 | Engstrom et al. | |
| 2008/0308115 | A1* | 12/2008 | Zimmermann | A24B 13/00 131/290 |
| 2009/0025740 | A1 | 1/2009 | Chappell, Sr. et al. | |
| 2009/0025741 | A1 | 1/2009 | Crawford et al. | |
| 2009/0126746 | A1 | 5/2009 | Strickland et al. | |
| 2010/0218779 | A1 | 9/2010 | Zhuang et al. | |
| 2010/0300465 | A1 | 12/2010 | Zimmermann | |
| 2011/0083680 | A1 | 4/2011 | Mishra et al. | |
| 2011/0180087 | A1 | 7/2011 | Gee et al. | |

FOREIGN PATENT DOCUMENTS

| | | | |
|---|---|---|---|
| EP | 0352107 | A2 | 1/1990 |
| EP | 0483500 | A1 | 5/1992 |
| EP | 0422898 | B1 | 9/1994 |
| EP | 0599425 | B1 | 10/1997 |
| EP | 1010639 | A1 | 6/2000 |
| EP | 1118274 | A2 | 7/2001 |
| GB | 725764 | A | 3/1955 |
| GB | 924052 | A | 4/1963 |
| GB | 1139684 | A | 1/1969 |
| GB | 1350740 | A | 4/1974 |
| GB | 2074838 | A | 11/1981 |
| JP | 03-240665 | A | 10/1991 |
| WO | WO 94-25356 | A1 | 11/1994 |
| WO | WO 97-45336 | A1 | 12/1997 |
| WO | WO 99-40799 | A1 | 8/1999 |
| WO | WO 00-57713 | | 10/2000 |
| WO | WO 01-70591 | A1 | 9/2001 |
| WO | WO 02-080707 | A1 | 10/2002 |
| WO | WO 03-028492 | A1 | 4/2003 |
| WO | WO 03-030881 | A1 | 4/2003 |
| WO | WO 03-053175 | A2 | 7/2003 |
| WO | WO 2004-009445 | A2 | 1/2004 |
| WO | WO 2004-052335 | A1 | 6/2004 |
| WO | WO 2004-056219 | A1 | 7/2004 |
| WO | WO 2004-058217 | A2 | 7/2004 |
| WO | WO 2004-064811 | A1 | 8/2004 |
| WO | WO 2004-066986 | A1 | 8/2004 |
| WO | WO 2004-095959 | A1 | 11/2004 |
| WO | WO 2005-027815 | A1 | 3/2005 |
| WO | WO 2005-046363 | A | 5/2005 |
| WO | WO 2005-077232 | A2 | 8/2005 |
| WO | WO 2005-084446 | A1 | 9/2005 |
| WO | WO 2006-004480 | A1 | 1/2006 |
| WO | WO 2006-039487 | A2 | 4/2006 |
| WO | WO 2006-065192 | A1 | 6/2006 |
| WO | WO 2006-090290 | A1 | 8/2006 |
| WO | WO 2006-105173 | A2 | 10/2006 |
| WO | WO 2006-120570 | A2 | 11/2006 |
| WO | WO 2006-127772 | A2 | 11/2006 |
| WO | WO 2007-037962 | A1 | 4/2007 |
| WO | WO 2007-057789 | A2 | 5/2007 |
| WO | WO 2007-057791 | A2 | 5/2007 |
| WO | WO 2007-082599 | A1 | 7/2007 |
| WO | WO 2007-104573 | A2 | 9/2007 |
| WO | WO 2007-126361 | A1 | 11/2007 |
| WO | WO 2008-016520 | A2 | 2/2008 |
| WO | WO 2008-042331 | A2 | 4/2008 |
| WO | WO 2008-104891 | A2 | 9/2008 |
| WO | WO 2008-140372 | A1 | 11/2008 |

OTHER PUBLICATIONS

Fechner, Petra M. et al., "Properties of Microcrystalline Cellulose and Powder Cellulose After Extrusion/Spheronization as Studied by Fourier Transform Raman Spectroscopy and Environmental Scanning Electron Microscopy", AAPS PharmSci. 2003; 5 (4), Article 31, pp. 1-13.

Koo, Otilia May Yue et al., "The Influence of Microcrystalline Cellulose Grade on Shape and Shape Distributions of Pellets Produced by Extrusion-Spheronization", Chem. Pharm. Bull. 49 (11) 2001, pp. 1383-1387.

Leffingwell, John C. et al., "Tobacco Flavoring for Smoking Products", R. J. Reynolds Tobacco Company, 1972, cover page and table of contents.

Satel, Sally M.D., "A Smokeless Alternative To Quitting," Apr. 6, 2004, The New York Times, Accessed Oct. 25, 2010; http://query.nytimes.com/gst/fullpage.html?res=9402EFD91E39F935A35757C0A9629C8B63.

Vervaet, Chris et al., "Extrusion-Spheronisation a Literature Review", International Journal of Pharmaceutics, 116 (1995), pp. 131-146.

* cited by examiner

MOIST BOTANICAL POUCH PROCESSING AND MOIST ORAL BOTANICAL POUCH PRODUCTS

CROSS REFERENCE TO RELATED APPLICATIONS

This application claims priority under 35 U.S.C. §119 to U.S. Provisional Application No. 61/138,833 entitled MOIST BOTANICAL POUCH PROCESSING AND MOIST ORAL BOTANICAL POUCH PRODUCTS, filed Dec. 18, 2008, the entire content of which is hereby incorporated by reference.

SUMMARY

Provided is method of making an oral pouched product containing moist botanical materials. The oral pouched product includes a pouch comprising a porous outer web and an inner filling material comprising solid moist botanical beads. In an embodiment, the botanical beads comprise loose strands of moist botanical material. In an embodiment, the moist botanical material comprises loose strands of moist smokeless tobacco (MST). In other embodiments, the moist botanical material can comprise tea fibers, coffee fibers, herb fibers, spice fibers, vegetable fibers and/or fruit fibers. The beads are contained within the pouch and are in the condition of being unraveled after pouching. The loose, fibrous moist botanical material and/or beads are not dried, heated and/or rewetted before or after formation of the beads and/or pouched product. Also, the pouched beads have the same moisture content as the loose, fibrous moist botanical material before extrusion and/or spheronization.

Also provided is a method of making beads having a moisture content of at least about 50% OV, more preferably about 50% OV to about 60% OV and most preferably about 55% OV to about 56% OV. The method includes forming loose moist botanical fibers having a moisture content of at least about 50% OV, preferably about 50% OV to about 60% OV. The method also includes extruding and/or spheronizing the moist botanical fibers to form beads. The beads and/or loose moist botanical fibers are not dried, heated and/or rewetted. Additionally, the beads at least partially unravel to the form of moist botanical fibers prior to extrusion and/or spheronization in greater than about 10 minutes. Preferably, the tobacco beads are placed in an oral pouched product before unraveling. Also preferably, the tobacco beads at least partially unravel within the oral pouched product prior to and/or during use by a consumer.

After forming the beads, the method includes feeding a porous outer web along a feed path, folding the porous outer web into a tubular formation, forming a longitudinal seam along overlapping edges of the porous outer web and a lower transverse seam across the tubular formation, feeding a quantity of an inner filling material comprising the beads through a nozzle and into the tubular formation above the transverse seam, and forming an upper transverse seam across the tubular formation to enclose the filling and form an oral pouched product.

DETAILED DESCRIPTION

Provided is an oral pouched product including a pouch that contains moist botanical beads. The moist botanical beads can comprise moist smokeless tobacco (MST) fibers and/or non-tobacco botanical fibers. Preferably, the beads comprise MST. Also provided is a method of pouching moist botanical fibers including moist smokeless tobacco.

Figure 1:
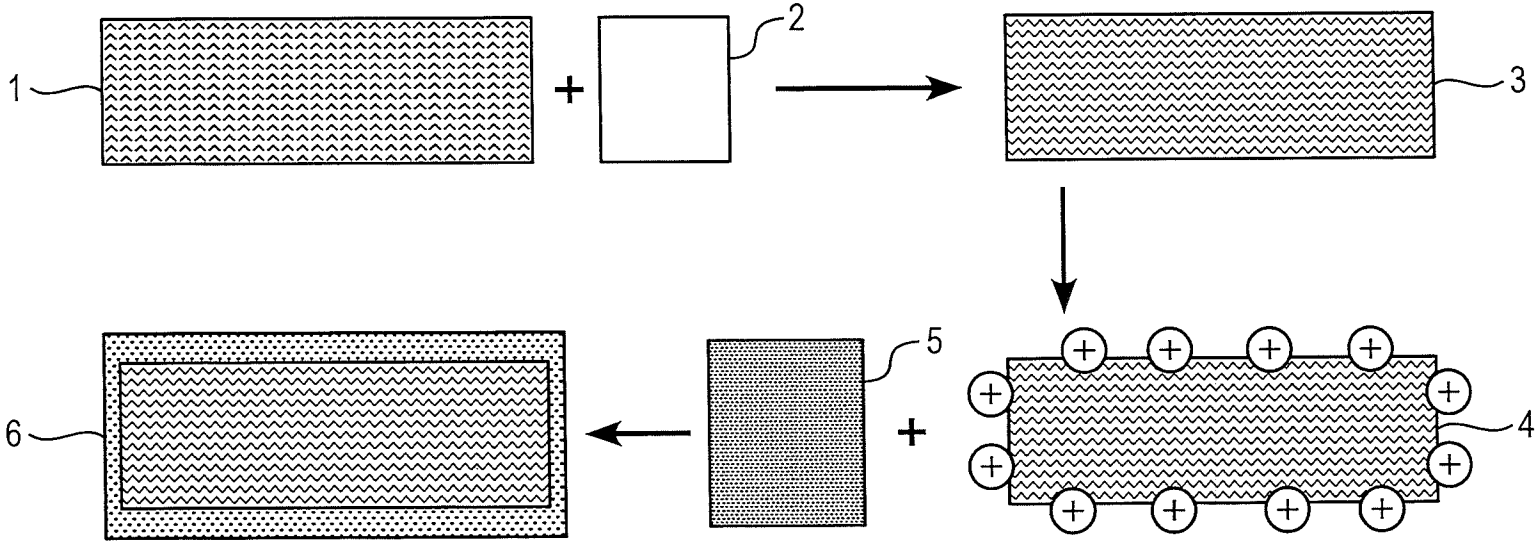
FIG. 1 is a flow chart showing a prior art process for pouching moist smokeless tobacco.

As shown in FIG. 1, prior art methods for pouching unflavored MST include drying 100, pouching 110, rewetting and/or flavoring 105 and then canning or otherwise packaging 115 the pouches for delivery to consumers. The MST is typically dried 100 using a fluid bed dryer, continuous screw drying and/or rotary drying. In addition, if MST is not dried, modifications to existing pouching machines must be made because MST does not properly flow from the hopper and into the pouch. In addition, unless the MST is first dried, the MST cannot be accurately metered and pouched on standard, unmodified poucher machines because of the high moisture content. After drying, the MST is typically pouched 110 and rewetted 105. Rewetting 105 after pouching causes MST to clump, which causes non-uniform flavor delivery due to the higher density of the clumps within the pouch as compared to non-clumped portions of MST contained within the pouch. Because the MST is dried, the flavor and organoleptic characteristics are undesirably changed from loose, fibrous MST.

Figure 2:
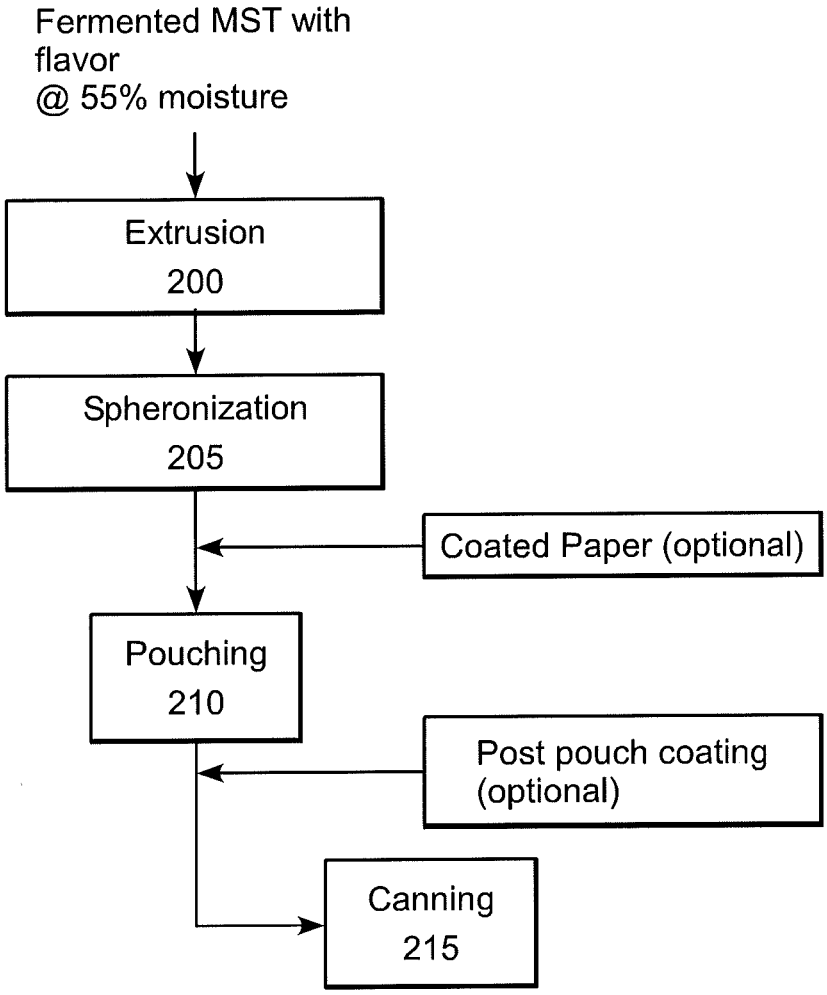
FIG. 2 is a flow chart showing a first embodiment of a process for forming and/or pouching moist botanical beads as described herein.

Thus, as provided herein and shown in FIG. 2, a method of forming and pouching moist botanical fibers including MST fibers is provided that obviates the need for rewetting of MST and/or other non-tobacco botanical fibers after pouching and pouching machine modifications, does not include a drying step and avoids clumps and resulting dense sections in the final oral pouched product. Thus, the oral pouched product as formed has a substantially uniform density of moist botanical material (e.g., MST) throughout the product. In a preferred embodiment, the oral pouched product only includes the moist botanical material processed as described herein.

The method includes forming beads by extruding at step 200 fermented, flavored MST fibers having a moisture content, determined as percent "oven volatiles" or "OV," is preferably about 50% to about 60% by weight. After extrusion, the extrudate is spheronized at step 205 to form beads, which are pouched at step 210 to form pouched products. The pouched products are canned at step 215. Optionally, the pouched products can include a coated paper wrapper that is coated before or after pouching at step 210. By extruding and spheronizing the MST and/or other non-tobacco botanical materials, the MST and/or other non-tobacco botanical materials is more easily and accurately measured and placed into pouch wrappers during the pouching step 210 on standard pouching equipment needing no modifications. Because of the moisture content of the MST and/or other non-tobacco botanical materials and the processing steps used herein, the beads unravel after pouching, such that the MST and/or other non-tobacco botanical materials within the pouches is in substantially the same form as the MST and/or other non-tobacco botanical materials prior to the extrusion step 200 and spheronization step 205. Preferably, the MST and/or other non-tobacco botanical materials lose only a negligible amount of water during extrusion and/or spheronization, are not dried and are not rewetted. Preferably, the moisture content of the MST and/or other non-tobacco botanical materials is substantially the same before and after processing. In contrast, prior art methods rewet the MST (as described above) resulting in clumps (dense portions) of MST and/or non-tobacco botanical materials within the pouched products.

As used herein, the term "moist smokeless tobacco" ("MST") refers to loose, fibrous leaf tobacco that is fermented and flavored prior to forming beads as described herein. Preferably, the MST includes a blend of tobaccos that are cut, fermented and flavored. Preferably, the MST is not dried, heated and/or rewetted so as to avoid altering the flavor and organoleptic properties of the MST after processing and placement in oral pouched products. Preferably, the MST is in the form of fine cut, loose tobacco fibers having short strands ranging in length from about 0.2 mm to about 15 mm (e.g., about 0.2 mm to about 12 mm, about 0.5 mm to about 10 mm, about 1.0 mm to about 8 mm, about 2.0 mm to about 6.0 mm or about 3.0 mm to about 5.0 mm) and having a width of about 0.2 mm to about 2.5 mm (e.g., about 0.2 mm to about 2.0 mm, about 0.5 mm to about 1.5 mm or about 0.75 mm to about 1.0 mm).

As used herein, the term "fermented" refers to the transformation of a material (such as tobacco) using one or more microorganisms, such as bacteria.

As used herein, the terms "moist botanical material," and "moist botanical fibers" refer to loose MST fibers and/or other loose, non-tobacco botanical leaf material including tea fibers, coffee fibers, vegetable fibers, spice fibers, herb fibers and/or fruit fibers. Preferably, the moist botanical material is not dried, heated and/or rewetted so as to avoid altering the flavor and organoleptic properties of the moist botanical material after processing and placement in oral pouched products. Preferably, the moist botanical material is in the form of loose fibers having short strands ranging in length from about 0.2 mm to about 15 mm (e.g., about 0.2 mm to about 12 mm, about 0.5 mm to about 10 mm, about 1.0 mm to about 8 mm, about 2.0 mm to about 6.0 mm or about 3.0 mm to about 5.0 mm) and having a width of about 0.2 mm to about 2.5 mm (e.g., about 0.2 mm to about 2.0 mm, about 0.5 mm to about 1.5 mm or about 0.75 mm to about 1.0 mm).

As used herein, the value of "oven volatiles" or "OV" is determined by placing a weighed sample of moist botanical material in an air-circulating oven and maintaining the sample in the oven, at a temperature of 100° C., for a period of three hours, after which the sample is again weighed. The difference in the two weight values expressed as a percentage of the original weight is defined as "oven volatiles" or "OV." Oven volatiles include water and anything that boils at a temperature of less than about 100° C.

As used herein, the term "about" when used in conjunction with a stated numerical value or range denotes somewhat more or somewhat less than the stated value or range, to within a range of ±10% of that stated.

As used herein, the terms "bead," "moist botanical bead," "moist botanical beads" and "beads" refer to MST and/or other non-tobacco botanical materials temporarily having the form of pellets, granules, spheres, and the like. Preferably, the beads have a moisture content of at least about 50% OV, and are in the condition of having been formed via extrusion, spheronization or both. After formation and pouching, the beads unfold and/or revert such that the moist botanical material contained therein is substantially in the original form of the MST fibers and/or other non-tobacco moist botanical fibers used to form the wet mass. Mechanical manipulation can be used to aid in reversion of the MST fibers and/or other non-tobacco botanical fibers to a form similar to that of the MST non-extruded and/or non-spheronized loose, fibrous moist botanical material.

As used herein, the terms "unfold," "unfolding," "unravel," and "unraveling" refer to the process of the beads reverting substantially to the original form of the MST fibers and/or other non-tobacco botanical fibers prior to extrusion and/or spheronization. Preferably, the original form of the MST fibers and/or other non-tobacco botanical fibers consists of loose fibers of MST and/or other non-tobacco botanical materials.

As used herein, the terms "free of clumps" and "clump-free" describe moist botanical material that has a substantially even density distribution throughout the oral pouched products.

In a preferred embodiment, the beads 12 (shown in FIGS. 4 and 5) can be prepared using known extrusion and/or spheronization processes for producing pharmaceutical pellets and flavored beads. For instance, the beads 12 can be formed by extrusion and spheronization, extrusion only or spheronization only. For example, the beads 12 can be extruded as disclosed in commonly owned U.S. Patent Application Publication No. 2007/0084476, filed Oct. 17, 2006, the entire content of which is incorporated herein by reference. Alternatively, the beads 12 can be extruded and/or spheronized as disclosed in commonly owned U.S. Patent Application Publication No. 2006/0272662, filed on Feb. 3, 2006, the entire content of which is incorporated herein by reference.

In a first embodiment, the beads 12 are formed by extrusion and spheronization. Preferably, fermented, flavored MST and/or non-tobacco botanical materials are cooled to about 4° C. to about 40° C. and then allowed to come to room temperature. The MST strands and/or other non-tobacco botanical fibers are then mixed with water and/or flavorants. Preferably, the MST fibers and/or other non-tobacco botanical fibers including water and/or flavorants have a moisture content of about 50% OV to about 60% OV, more preferably about 55% OV to about 60% OV. The MST fibers and/or other non-tobacco botanical fibers can be mixed, for example, in a mixer, such as a planetary mixer to form a dough-like mixture. The dough-like mixture can then be forced through an extruder to form an extrudate at ambient temperature. Since the extrusion is carried out at ambient temperature, the organoleptic properties and/or flavor of the MST are not changed during processing. Preferably, the extrusion can be carried out using extruders such as the screw, sieve and basket, roll and ram type extruders. In an embodiment, a binder can also be added to the dough-like mixture prior to extrusion. Preferably, the extrudate is broken into short strands having a diameter of about 0.6 mm to about 1.2 mm, more preferably a diameter of about 0.6 mm to about 2.5 mm, and a length of about 5 mm to about 25 mm. The size and shape of the extrudate can depend on the extrusion nozzle used. Also, the extrudate length can depend on the weight of the extrudate as the strands will break off based on the weight. In a preferred embodiment, the strands of extrudate are then subjected to a spheronization process which uses high centrifugal force to form the beads 12, which have a substantially spherical shape. During spheronization the extrudate is compacted to form the beads 12. The beads 12 can be spheronized from the extrudate by using an LCI QJ-230T Marumerizer or a spinning friction plate that effects rounding of the extrudate at a suitable rotation speed (e.g., 1200 RPM) for a suitable time (e.g., 10 minutes). In an embodiment, the dough-like mixture is extruded through suitably sized pierced screens and spheronized using a rotating disk having a grooved surface. Preferably, spheronization also occurs at ambient temperature. However, during spheronization, friction may cause some heat to be generated. Thus, the spheronizer may be cooled during use using a water cooling system. Preferably, the moisture content of the moist botanical material remains substantially the same before, during and/or after extrusion and/or spheronization, such that there is no need to add moisture to the beads after formation. However, minor variations in the moisture content may occur.

In a second embodiment, the MST fibers and/or other non-tobacco botanical fibers can be formed as described above and then spheronized without first extruding the MST fibers and/or other non-tobacco botanical fibers to form beads. In a preferred embodiment, MST strands and/or other non-tobacco botanical materials, water, flavorants and an optional binder are mixed to form a dough-like mixture having a moisture content of about 50% OV to about 60% OV. Preferably, the dough-like mixture is broken into pieces by hand or by cutting the dough-like mixture into pieces prior to spheronization. Alternatively, dough-like mixture is broken apart during spheronization. The pieces of dough-like mixture are then placed in the spheronizer at a suitable rotation speed for a suitable time to form beads 12. The size of the pieces of dough-like mixture placed in the spheronizer can affect the size of the resulting tobacco beads 12. Thus, the size of the pieces of dough-like mixture can be chosen to produce beads 12 having preferred dimensions and/or weight. For instance, the pieces can have dimensions of about 0.2 mm to about 1.2 mm in width and 5 mm to about 25 mm in length to produce beads having diameters of about 1 mm to about 3 mm.

In a third embodiment, the dough-like mixture, formed as described above, can be extruded to form pellets or other flowable forms having widths and/or lengths of about 1.0 mm to about 5.0 mm and/or diameters of about 1.0 mm to about 5.0 mm and more preferably about 1.0 mm to about 3.0 mm (e.g., about 2.0 mm to about 4.0 mm or about 3.0 mm to about 5.0 mm). Typically, the size of the pellets formed will depend on the size and shape of the extruder nozzle. In an embodiment, a round nozzle can be used to form pellets having a diameter of about 1 mm to about 3 mm.

The resulting beads 12 are preferably in the form of spheroids that are substantially round or oval in shape. However, as used herein, the term "beads," and "beads" can refer to irregularly shaped pellets, granules, spheroids and/or other flowable forms. Further, each spheroidal bead 12 can have a diameter of about 1.0 mm to about 5.0 mm (e.g., about 1.0 mm to about 4.0 mm, about 2.0 mm to about 3.0 mm, about 3.0 mm to about 5.0 mm or about 1.0 mm to about 3.0 mm). Alternatively, each bead 12 can have a length and/or a width of about 1.0 mm to about 5.0 mm (e.g., about 1.0 mm to about 4.0 mm, about 2.0 mm to about 3.0 mm, about 3.0 mm to about 5.0 mm or about 1.0 mm to about 3.0 mm). Preferably, the beads include strands of loose, flavored moist botanical fibers having a length that is greater than a maximum dimension of the beads 12.

Due to the form of the beads, the beads 12 are easily pouched using typical high speed vertical and horizontal pouching machines as described above as compared to loose, fibrous moist smokeless tobacco and/or other loose fibrous botanical materials. Once in the pouch, the beads unfold over a period of time, such that the beads at least partially unravel to a form similar to that of non-extruded and/or non-spheronized loose, fibrous MST and/or loose, fibrous non-tobacco botanical materials. Since the beads 12 are never dried, the beads need not be rewetted after pouching to achieve desirable moisture contents. Rewetting tends to form clumps and/or areas of higher and lower density within the pouched product. Since the oral pouched product is not rewetted, the oral pouched product is clump-free. Thus, flavors are substantially uniformly released from the pouched product. In addition, since the MST and/or non-tobacco botanical materials are not dried prior to and/or after pouching, the flavor, feel and other organoleptic properties of the MST and/or non-tobacco botanical materials are not changed by heating and/or drying.

Not wishing to be bound by theory, it is also believed that the unraveling of the beads prior to and/or during consumer use provides better flavor as compared to rewetted loose, fibrous moist botanical materials because the unraveled materials have no clumps or dense sections that deliver flavor at uneven rates In an embodiment, the beads 12 can contain binder ingredients. The mixing step includes mixing the moist botanical materials, preferably MST, with a dry and/or liquid binder, water and optional flavorants to form a wet mass. The wet mass is then extruded, extruded and spheronized or spheronized as described above. However, beads 12 containing a binder may take longer to unravel. Depending on when the beads 12 are pouched and ultimately used by the consumer, the beads 12 may have time to unravel to the unprocessed form so as to provide better flavor that is more consistent with the flavor of loose, fibrous moist botanical material than flavor beads or pouched products containing clumps and dense regions. In an embodiment, the beads 12 unravel before and/or during handling and placement of the oral pouched product in a consumer's mouth.

In an embodiment, binders can be added in dry and/or liquid form. Liquid binders may be added to increase the moisture content of the wet mass as needed. In another embodiment, the binder may be a suitable dry binder, an extrusion and spheronization aiding composition and reagent, a water swellable polymer, polymer binders, or mixtures of these reagents. Beads containing binders typically retain their form more readily than beads without binders, thereby unraveling at a slower rate than beads not including binders.

Preferably, the extrusion and spheronization aiding reagents are those which are capable of holding liquid like a sponge. These reagents also further restrict the separation of the liquid from the solid that can occur during extrusion and spheronization processes. The extrusion and spheronization aiding reagents include but are not limited to microcrystalline cellulose (MCC), pectinic acid, lactose, and glyceryl monostearate, and combinations thereof.

Suitable water-swellable polymers include, without limitation, hydroxypropyl methylcellulose (HPMC), low substituted hydroxypropyl cellulose (L-HPC), and hydroxypropyl cellulose (HPC).

Suitable polymer binders include, without limitation, polyvinyl pyrolidone (PVP), EUDRAGIT®, and cellulose ethers.

Figure 4:
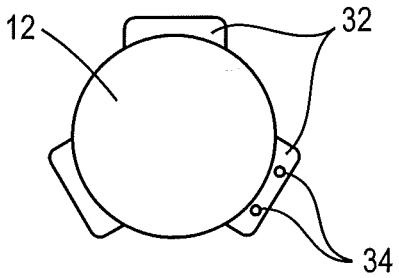
FIG. 4 is an illustration of a moist botanical bead.

In an embodiment, as seen in FIG. 4, the beads 12 can include at least one polymeric coating 32 over a portion of each bead 12. Preferably, the coating 32 is not continuous so as not to impede the unraveling of the bead 12 after pouching. However, the use of a partial coating 32 can slow the rate of unraveling of the beads 12. Preferably, at least one flavorant 34 can also be added to the coatings 32 of the beads 12.

In a preferred embodiment, the flavorants are added to the beads 12 during manufacture. Preferably, the flavorants are added to the moist botanical material prior to formation of the dough-like mixture. Alternatively, the flavorants may be added to the beads after formation via partial coating, spraying and the like. The flavorant includes flavor materials that are practically unlimited, although water-soluble, alcohol-soluble and oil-soluble flavors are preferable.

Suitable flavorants include, without limitation, lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, chocolate, cassia, ylang-ylang, sage, spearmint, ginger, coriander, coffee and other fruit flavors, herbal flavors and/or spice flavors. Each of the flavors can be used singly or mixed with others.

The flavorant can also be in the form of a solid matrix (liquid flavorants spray dried with a starch). The flavorant can also be in the form of solids, liquids or gels. The flavorant can be present in the beads in an amount of up to 50% by weight (e.g., 0.1 to 5%, 5 to 10%, 10 to 15%, 15 to 20%, 20 to 25%, 25 to 30%, 30 to 35%, 35 to 40%, 40 to 45% or 45 to 50%).

In one embodiment, the beads can be tailored to have controlled-delivery release of flavorants and/or active compounds. For example, diffusion of the flavors from the beads can be adjusted by bead porosity and density as well as by any controlled-release coating added to the beads. In an embodiment, the beads can also be partially coated with polymeric coatings of different functionalities and or compositions (e.g., single or multiple overcoats depending on the application) to control the delivery and release of the active compounds.

In another embodiment, the beads can act as a delivery system for delivering flavors naturally occurring in the components of the bead formulation. Alternatively, the beads can act as a medium for creating and/or enhancing naturally occurring flavors through Maillard, enzymatic, or other types of reactions.

If desired, diluent agents can be added to the beads. Diluent agents which can be used for this purpose include powdered starch, such as but not limited to corn starch and potato starch, rice powder, calcium carbonate, diatomaceous earth, talc, acetate powder, and pulp flock.

In one embodiment, the loose, fibrous MST used to make the beads can be from any type of tobacco used to prepare loose, fibrous moist smokeless tobacco, such as but not limited to Burley, Bright, Oriental, or blends thereof, as well as genetically altered, chemically altered, or mechanically altered tobacco plants and blends thereof. The type of tobacco is preferably selected from the group consisting of Burley, Bright, and Oriental. The blend of tobacco can include up to 5%, 10%, 15%, 20%, 25%, 30%, 35%, 40%, 45%, 50%, 55%, 60%, 65%, 70%, 75%, 80%, 85%, 90%, 95%, or 100% by weight of Burley; up to 5%, 10%, 15%, 20%, 25%, 30%, 35%, 40%, 45%, 50%, 55%, 60%, 65%, 70%, 75%, 80%, 85%, 90%, 95%, or 100% by weight of Bright; and/or up to 5%, 10%, 15%, 20%, 25%, 30%, 35%, 40%, 45%, 50%, 55%, 60%, 65%, 70%, 75%, 80%, 85%, 90%, 95%, or 100% by weight of Oriental.

In an embodiment, the beads can also include a supplemental amount of non-tobacco botanical materials mixed in with the MST. Suitable non-tobacco botanical materials include, without limitation, fruit fibers, vegetable fibers or plant fibers, such as shreds of lettuce, cotton, flax, beet fiber, cellulosic fibers, blends thereof and the like.

The blend of the tobacco used, the formulation of the optional dry or liquid binder, the concentration of liquid in the beads, and the size of the beads are all elements which can be altered alone or in combination with each other to achieve a desired taste.

The flavorants for the beads can be incorporated for example using a solvent mixture. Using a solvent mixture, it is possible to incorporate the optional flavor constituents into the cellulosic or fiber-based binder containing beads in minute amounts, on the order of parts per million.

Figure 3A:
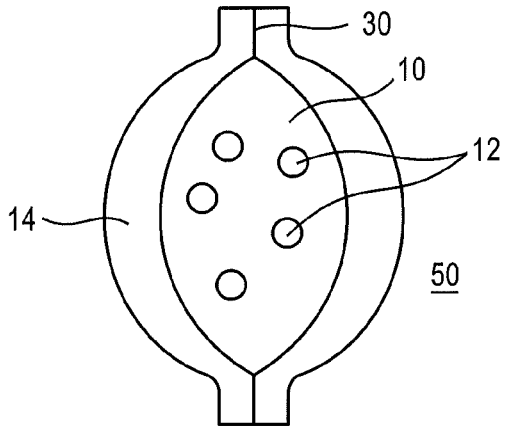
FIG. 3A is an illustration of an oral pouched product including moist botanical beads.

As shown in FIG. 3A, the oral pouched product 50 includes an inner filling material 10. The inner filling material includes beads 12 formed as described herein. In a preferred embodiment, the inner filling material contains only beads 12. However, in other embodiments, the inner filling material comprises beads 12 and other tobacco or non-tobacco material. Preferably, the inner filling material 10 of the oral pouched product 50 is substantially uniformly distributed throughout the oral pouched product 50 such that the oral pouched product 50 does not have regions of higher and/or lower filling density and/or clumps that would unevenly release flavors. Preferably, each oral pouched product 50 includes about 0.5 g to about 2 g of beads, more particularly about 1.25 g to about 1.75 g of beads. For example, an oral pouched product can include about 1.7 g of beads having a moisture content of about 55% OV.

After a period of time, the beads 12 at least partially unravel, preferably after pouching, such that the beads 12 unravel substantially to the original shape and/or form of the moist botanical material used to form the beads. Preferably, multiple beads 12 are enclosed within a porous outer web 14 that forms the pouch.

In a preferred embodiment, the porous outer web 14 comprises paper suitable for oral pouched products commonly referred to as "snus" or snuff. For example, the porous outer web 14 can be formed of a cellulose fiber material, such as tea bag material or materials typically used to form snus pouches. For example, the porous outer web 14 can be formed of paper, fabric, and/or disintegrable or non-disintegrable films. Preferably, the porous outer web 14 has a neutral taste or aroma. However, in other embodiments, the material used to form the porous outer web 14 can be flavored. The porous outer web 14 can be selected to have desired properties of stain resistance, water permeability and/or porosity, and/or water insolubility.

Additionally, the porous outer web 14 can be provided with predetermined levels for basis weight and/or wet strength in order to reduce occurrence of breakage of the porous outer web 14 during manufacturing operations, storage and use. For example, porous outer webs 14 can be provided with a basis weight of about 5 to about 25 g/m$^2$, such as 5-10, 10-15, 15-20, or 20-25 grams/meters$^2$ (g/m$^2$) depending upon the final usage requirements, and/or a wet tensile cross-direction (CD) strength of about 15 to about 75 N/m, such as 15-30, 30-45, 45-60, or 60-75 Newtons/meter (N/m) depending upon the final usage requirements. One exemplary material is a tea bag material with a basis weight of about 16.5 g/m2 with a wet tensile CD strength of 68 N/m.

It is also noted that the thickness of the porous outer web 14 can be varied to achieve desired levels of solubility through the pouch wrapper during use.

In a preferred embodiment, the porous outer web 14 maintains sufficient structural integrity during the time period that the pouched product is used so that the inner material 10 is retained therein. In an embodiment, flavorants may be added to the porous outer web 14 to provide additional flavor to the user.

Figure 3B:
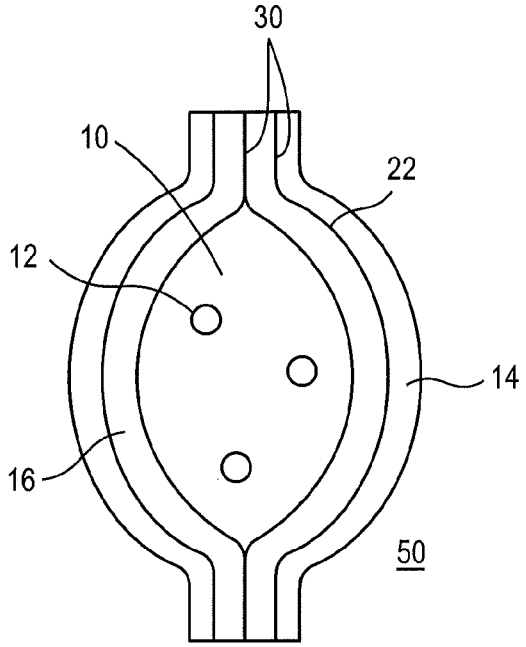
FIG. 3B is an illustration of a second embodiment of an oral pouched product including moist botanical beads.
Figure 3C:
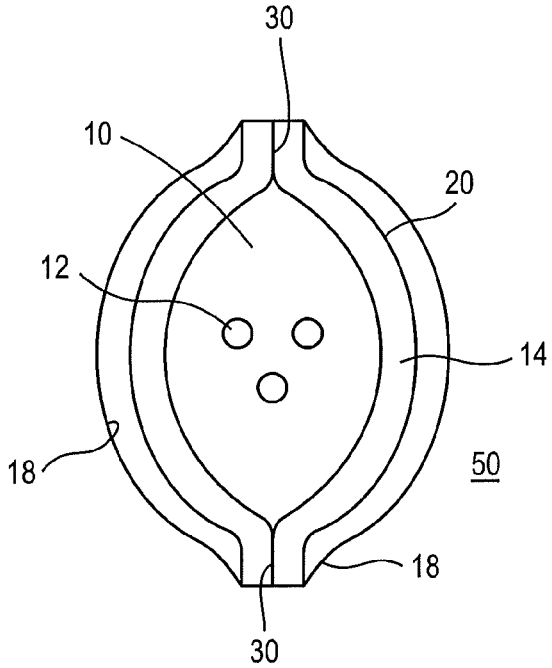
FIG. 3C is an illustration of a third embodiment of an oral pouched product including moist botanical beads.

In an embodiment, the porous outer web 14 can include at least one coating 18, as shown in FIG. 3C, at least partially coating an outer surface 20 of the porous outer web 14. The porous outer web 14 can also include an inner web 16, as shown in FIG. 3B, which lines an interior surface 22 of the porous outer web 14. In an embodiment, the porous outer web 14 can include at least one coating 18 and at least one inner web 16. In other embodiments, the porous outer web 14 can include a coating 18 without an inner web 16 or an inner web 16 without a coating 18. The thickness of the coating 18 and/or inner web 16 should be controlled so as to maintain a desired amount of permeability through the pouch during use.

Suitable inner webs can be formed of the same material as the porous outer web 14, such that the inner web aids in reducing staining of the porous outer web 14. Alternatively, the inner web can be formed of dissolvable and/or disintegrable polymeric films that can provide additional moisture and/or flavors to the user upon dissolution thereof.

In a preferred embodiment, the oral pouched product 50 including the beads 12 is sized and configured to fit comfortably in a user's mouth. The pouched product 50 can be sized and configured for comfortable placement in a user's mouth between the cheek and gum. Preferably, the pouched product 50 has dimensions of less than about 3 inches, and more preferably less than about 2.5 inches (e.g., less than about 2 inches, less than about 1.5 inches).

The oral pouched product 50 can be formed in a variety of shapes including, but not limited to, square, rectangle, moon, crescent, boomerang, leaf, oval, round or oblong shape. Preferably, sharp corners are avoided to prevent oral discomfort. The oral pouched product 50 is sealed around one or more of the edges of the porous outer web 14 to contain the inner material 10 within the pouch. The shape of the oral pouched product 50 can be chosen to indicate the flavor and/or other contents of the oral pouched product 50. For example, a green color can be used to indicate a mint flavor.

The pouch forming operations can be executed by feeding a ribbon of porous outer web material through a poucher machine, such as those manufactured by Merz Verpackungsmaschinen GmbH, Lich, Germany. Such systems typically include a folding horn or shoe, a cutter and a feeder, which cooperate to repetitively fold the ribbon of porous outer web into a tube, close-off and seal an end portion of the tube, feed a measured amount of inner filling material into the closed-off tube to create a filled portion of the tube and seal and sever the filled portion of the tube to repetitively form individual pouch products. Typically, moist botanical materials are not accurately measured and filled using unmodified poucher machines because of the moisture content. The moisture content can cause loose moist tobacco materials to stick in the machine and/or nozzles thereof so as to prevent accurate delivery of the moist tobacco materials to the pouch. However, because the moist botanical material described herein is in bead form, the poucher machine need not be modified to obtain substantially uniform measuring and filling of the beads into the pouches.

In a preferred embodiment, an inner web is drawn into contact with the first ribbon of porous outer web material as the two ribbons of web material are drawn into the poucher.

In an embodiment, the optional coating can be continuously applied to a side of a ribbon of porous outer web material. The porous outer web material including the coating can then be continuously fed with the optional inner web to form pouched products during a pouch forming and filling operation.

Figure 6:
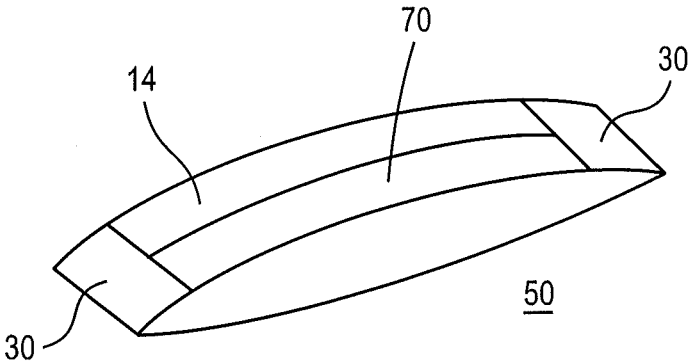
FIG. 6 is an illustration of a fourth embodiment of an oral pouched product including moist botanical beads and having a longitudinal seam.

In a preferred embodiment, the porous outer web material can be, for example about 31 mm wide, and the inner web can be, for example, about 26 mm wide. The porous outer web material and the inner web can be fed along a feedpath and folded into a tubular formation. In so doing, the longitudinal edge portions of the web material are brought into an overlapping relation and sealed to form a longitudinal seal 70 (shown in FIG. 6), which is preferably about 3 mm wide in the exemplary embodiment.

The pouched products 50 are continuously formed by introduction of predetermined amounts of the inner filling material 10, comprising tobacco beads 12, into the tubular form above a transverse seam, formation of an upper transverse seam above the filling and cutting the tubular formation at locations along the length of the tubular formation to form individual pouches 50.

Sealing may be accomplished by any suitable sealing method, such as, for example, adhesive or by mutual sealing. Mutual sealing may be thermal or sonic. Preferably, sealing is accomplished by thermal sealing. The end seals 30 can comprise two layers of porous outer web material, and optionally one or more layers of the inner web. In an embodiment, the seals 30, 70 can include at least one coating 18 that at least partially coats the seal 30, 70.

Preferably, the pores in the outer web 14 allow flavors to diffuse through the material and into the user's mouth. In use, saliva from a user's mouth flows into the pouch, mixes with the MST to release juices, and flows back into the user's mouth to deliver the flavors and juices from the MST.

In an embodiment, additional flavors in liquid form and/or moisture can be added to the outside of the pouch after pouching to increase the "wet" look and feel of the pouch. The flavors and/or moisture can be sprayed onto the pouch to increase the moisture content by about 0.5% to about 5%, more preferably about 2% to about 3%. This minor increase in moisture content does not affect the beads contained within the pouch and therefore does not cause clumping or dense sections of filling material within the oral pouched product 50.

Preferably, the oral pouched product 50 does not include preservatives and has a shelf life of at least about 1 months and more preferably at least about 3 months, and most preferably at least about 4 months. In an embodiment, the oral pouched product 50 can be refrigerated to lengthen the shelf-life. Alternatively, the oral pouched product 50 can include preservatives to lengthen the shelf-life.

Figure 5:
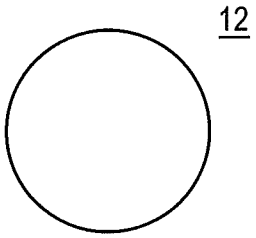
FIG. 5 is an illustration of a moist botanical bead including a coating on a portion of the moist botanical bead.

As shown in FIG. 5, in a preferred embodiment, the beads 12 are formed of moist botanical materials having a moisture content before during and/or after processing of about 50% to about 60% OV and more preferably about 55% to about 56% OV. Preferably, the beads 12 include a majority amount of loose, fibrous moist smokeless tobacco. Also preferably, the beads 12 include at least one flavorant. Because of the high moisture content of the beads 12, the beads 12 at least partially unravel after formation. Since the moisture content is not altered, the flavor and other organoleptic properties of the moist botanical material remain the same before and/or after processing. Preferably, the moist botanical material is neither dried nor heated prior to, during and/or after formation of the tobacco beads.

In an embodiment, the beads 12 unravel in less than about 60 days, more preferably in less than about 30 days, and most preferably in less than about 15 days. In an embodiment, the beads 12 unravel in less than about 24 hours, less than about 20 hours, less than about 16 hours, less than about 12 hours or less than about 8 hours. The beads preferably do not unravel within at least about 10 minutes of formation of the beads 12. In another embodiment, the beads 12 unravel during placement in a consumer's mouth and/or during initial enjoyment of the oral pouched product 50 by the consumer. In a preferred embodiment, the beads 12 are pouched prior to unraveling so that the beads 12 are still in a flowable form that can be pouched on existing pouching equipment without modifications. The beads 12 contained within an oral pouched product 50 can at least partially unravel at the same and/or differing rates.

In an embodiment, mechanical manipulation of the oral pouched products 50 prior to packaging can aid in unraveling the beads 12 contained therein. In other embodiments, mechanical manipulation is not needed to unravel the beads 12. Mechanical manipulation can include kneading and/or squeezing of the pouch product after filling and sealing, but prior to packaging. Such kneading and/or squeezing is preferably performed by machine, but can be performed by hand. In an embodiment, the beads 12 unravel in reaction to handling during packaging and/or shipping.

In an embodiment, beads and/or the coating on the beads and/or pouch wrapper can include additives, such as vitamins, minerals, nutraceuticals, energizing agents, soothing agents, sweeteners, coloring agents, amino acids, antioxidants, preservatives and/or combinations thereof.

In an embodiment, suitable sweeteners include, without limitation, monosaccharides, disaccharides, and polysaccharides, xylose, ribose, sucrose, maltose, mannitol, sorbitol, xylitol, fructose, glucose, mannose, sucralose, and combinations thereof.

Soothing agents can be included to provide a soothing sensation to the throat and oral cavity. Suitable soothing agents include, without limitation, chamomile, lavender, jasmine, and the like.

Suitable energizing ingredients include, without limitation, caffeine, taurine, and guarana.

Suitable vitamins include, without limitation, vitamin A (retinol), vitamin D (cholecalciferol), vitamin E group, vitamin K group (phylloquinones and menaquinones), thiamine (vitamin $B_1$), riboflavin (vitamin $B_2$), niacin, niacinamide, pyridoxine (vitamin $B_6$ group), folic acid, choline, inositol, vitamin $B_{12}$ (cobalamins), PABA (para-aminobezoic acid), biotin, vitamin C (ascorbic acid), and mixtures thereof. The amount of vitamins incorporated into a pouch product can be varied according to the type of vitamin and the intended user. For example, the amount of vitamins may be formulated to include an amount less than or equal to the recommendations of the United States Department of Agriculture Recommended Daily Allowances.

As used herein, the term "nutraceuticals" refers to any ingredient in foods that has a beneficial effect on human health. Nutraceuticals include particular compounds and/or compositions isolated from natural food sources and genetically modified food sources. For example, nutraceuticals include various phytonutrients derived from natural plants and genetically engineered plants.

Suitable minerals include, without limitation, calcium, magnesium, phosphorus, iron, zinc, iodine, selenium, potassium, copper, manganese, molybdenum, chromium, and mixtures thereof. The amount of minerals incorporated into the pouched product can be varied according to the type of vitamin and the intended user. For example, the amount of minerals may be formulated to include an amount less than or equal to the recommendations of the United States Department of Agriculture Recommended Daily Allowances.

Suitable amino acids include, without limitation, the eight essential amino acids that cannot be biosynthetically produced in humans, including valine, leucine, isoleucine, lysine, threonine, tryptophan, methionine, and phenylalanine. Examples of suitable amino acids include the non-essential amino acids including alanine, arginine, asparagine, aspartic acid, cysteine, glutamic acid, glutamine, glycine, histidine, proline, serine, and tyrosine.

In another embodiment, the oral pouched product 50 can include various active agents having antioxidant properties that can delay the ageing process. For example, the active ingredients that can be extracted from Ginkgo biloba include flavonoid glycosides ("ginkgoflavonoids"), such as (iso) quercitin, kaempferol, kaempferol-3-rhamnosides, isorhamnetin, luteolin, luteolin glycosides, sitosterol glycosides, and hexacyclic terpene lactones, referred to as "ginkgolides" or "bilobalides." The active ingredients that can be extracted from *Camellia sinensis*, such as green tea, include various "tea tannins," such as epicatechol, epigallocatechol, epigallocatechol gallate, epigallocatechol gallate, theaflavin, theaflavin monogallate A or B, and theaflavin digallate. The active ingredients that can be extracted from *Vaccinium myrtillus*, such as blueberry, include at least 15 different anthocyanosides, such as delphinidin, anthocyanosides, myrtin, epimyrtin, phenolic acids, glycosides, quercitrin, isoquercitrin, and hyperoside. The active ingredients that can be extracted from *Vinis vitifera*, such as grapes, include polyphenols, catechols, quercitrins, and resveratrols. The active ingredients that can be extracted from *Olea europensis*, such as the leaves of olive trees, include oleuropein. Many active ingredients identified from these and other plant sources associated with the neutralization of free radicals and useful for delaying the ageing process are contemplated. The active ingredients of *Trifolium pratense*, such as purple clovers (i.e., common purple trefoils), include isoflavones or isoflavone glucosides, daidzein, genestein, formononentin, biochanin A, ononin, and sissostrin. The health-promoting properties of compounds derived from *Panax*, a genus that includes Ginseng, are well-established. These and other botanicals, botanical extracts, and bioactive compounds are contemplated.

Such botanical extracts can be prepared by various methods known in the art, including maceration, remaceration, digestion, agitation maceration, vortex extraction, ultrasonic extraction, countercurrent extraction, percolation, repercolation, evacolation, diacolation, and solid/liquid extraction under continuous reflux. Other antioxidants known in the art are also contemplated.

Suitable preservatives for inclusion in the pouched product include, without limitation, methyl paraben, propyl paraben, sodium propionate, potassium sorbate, sodium benzoate and the like.

Products constructed in accordance with the embodiments described herein provide a soft mouth feel including soft edges and a pliable body. In an embodiment, pouched products having a double layer structure provide enhanced wet strength of the oral pouched product and enhanced capacity to withstand handling during packaging and use.

While the foregoing describes in detail an oral pouched product comprising beads and methods of making the beads and oral pouched products with reference to specific embodiments thereof, it will be apparent to one skilled in the art that various changes and modifications equivalents to the oral pouched product and process steps may be employed, which do not materially depart from the spirit and scope of the invention.

We claim:

1. A method of making an oral pouched product comprising:

forming beads comprising compacted loose, flavored, moist botanical fibers having a moisture content of about 50% OV to about 60% OV;

feeding a porous outer web along a feed path;

folding the porous outer web into a tubular formation;

forming a longitudinal seam along overlapping edges of the porous outer web and a lower transverse seam across the tubular formation;

feeding a quantity of an inner filling material comprising the beads through a nozzle and into the tubular formation above the transverse seam; and forming an upper transverse seam across the tubular formation to enclose the filling and form an oral pouched product, wherein the beads are adapted to at least partially unravel after said forming the upper transverse seam; and wherein the loose, flavored, moist botanical fibers are not dried and/or heated to reduce moisture after forming the beads.

2. The method of claim 1, wherein the oral pouched product is packaged in a container without adding moisture to the pouched product.

3. The method of claim 1, wherein the beads include strands of the loose, flavored, moist botanical fibers, the strands having a length greater than a maximum dimension of the beads.

4. The method of claim 1, further including spraying the oral pouched product with a liquid to increase a total moisture content of the oral pouched product by about 0.5% OV to about 5% OV.

5. The method of claim 1, wherein the beads have a maximum dimension of about 1 mm to about 5 mm.

6. The method of claim 1, wherein the loose, flavored, moist botanical fibers consist essentially of moist smokeless tobacco.

7. The method of claim 1, wherein the loose, flavored, moist botanical fibers consist essentially of short strands ranging in length from about 0.2 mm to about 15 mm and ranging in width from about 0.2 mm to about 2.5 mm.

* * * * *